US005803635A

United States Patent [19]

Austin et al.

[11] Patent Number: 5,803,635

[45] Date of Patent: Sep. 8, 1998

[54] METHOD AND APPARATUS TO DETERMINE POSITION AND SENSE MOTION OF LINERLESS MEDIA

[75] Inventors: Pixie Ann Austin, Marysville; Cathy Aragon, Everett, both of Wash.

[73] Assignee: Intermec Corporation, Everett, Wash.

[21] Appl. No.: 435,024

[22] Filed: May 4, 1995

[51] Int. Cl.[6] ..... B41J 29/00

[52] U.S. Cl. ..... 400/708; 101/288; 400/579

[58] Field of Search ..... 400/708, 708.1, 400/709, 709.1, 709.2, 706, 579, 560, 581, 630, 613; 101/288

[56] References Cited

U.S. PATENT DOCUMENTS

| | | | |
|---|---|---|---|
| 5,061,946 | 10/1991 | Helmbold et al. | 400/708 |
| 5,322,380 | 6/1994 | Crocker | 400/611 |
| 5,335,837 | 8/1994 | Saeki et al. | 400/708 |
| 5,492,423 | 2/1996 | Smith | 400/279 |

FOREIGN PATENT DOCUMENTS

| | | | |
|---|---|---|---|
| 0032603 | 3/1980 | Japan | 400/708 |
| 0187570 | 9/1985 | Japan | 400/708 |
| 0305666 | 12/1990 | Japan | 400/708 |

*Primary Examiner*—Christopher A. Bennett
*Attorney, Agent, or Firm*—Graham & James LLP

[57] ABSTRACT

Linerless media for labels is visibly or invisibly marked along its length with marks or small holes to indicate motion marks and/or position marks related to pre-printed label information. The marks are used to properly position pre-printed label information with respect to a printer printhead. The marks can also be used to detect critical speeds of the media that can cause problems such as standing waves or poor print quality from the printhead. The marks are also used to position and print on linerless media being pulled by hand through a printer having no drive motor.

12 Claims, 7 Drawing Sheets

METHOD AND APPARATUS TO DETERMINE POSITION AND SENSE MOTION OF LINERLESS MEDIA

BACKGROUND OF THE INVENTION

This invention relates to printers for printing on media and the media therefor, and more particularly, to a printing system for printing labels at pre-established positions on a continuous strip of media comprising, a strip of media having a printing surface for receiving printed label information, the printing surface having position and/or timing/motion marks thereon along the length thereof associated with pre-defined positions in a manner which does not visually impair subsequent printing on the printing surface; and, a printer for printing on the printing surface, the printer including means for sensing the position and/or timing/motion marks to find pre-defined positions and print lines of data at proper times.

Printing apparatus for printing labels on strip media is known in the art and takes various shapes. A typical prior art printer is depicted in FIG. 1 where it is generally indicated as 10. The printer 10 prints on strip media 12 from the supply roll 14 as it passes over a platen 16 using a printhead 18. The media 12 is moved through the printer 10 by the stepping motor 20 which drives a drive roller 22 while the media 12 is positioned between the drive roller 22 and a pinch roller 24. An encoded wheel 26 is sometimes used to determine the speed or motion of the media 12. If the media 12 is started from a known position, the encoded wheel 26 can also be employed to constantly know the position of the media 12. As depicted in the drawing figure, the encoded wheel 26 can be driven by the motor 20 or from a roller (such as 24) rolling along the media 12. A sensor 28 is employed to read the encoded wheel 26 and provide an electrical signal to computational equipment (not shown) associated with the printer 10. There are numerous problems associated with such an approach, not the least of which is the cost of the encoder and gear train necessary to determine the position. If the media 12 is a so-called "linerless" media having adhesive on its reverse surface for direct application to a surface, a release coating is typically applied to the printing surface to keep the media 12 from sticking to itself while in the roll 14. If a roller such as 24 is employed to drive the encoded wheel 26, it may slip on the release coating thereby giving false readings.

As depicted in FIG. 2, the motor 20 does not drive the media 12 at a constant rate. Rather, it moves in a series of steps. As depicted in FIG. 3, this pulling action may result in the creation of standing waves 30 in the media 12 or skidding or sliding of the media 12 at certain speeds. While shown exaggerated in the drawing figure for ease of understanding, the standing waves 30 can interfere with the quality of the printing on the media 12. Thus, having a source of accurate information on the speed of the media 12 through the printer 10 can be of importance. Since different types and thickness of media 12 will have any standing waves 30 at different speeds, it would be better if the speed information was media-oriented rather than drive motor oriented. Also, if one were to make a printer 10 where the media 12 was not driven by a motor 20 amenable to also driving an encoded wheel 26, having the speed information sourced in the media 12 would be an absolute necessity.

With respect to positional information, that too is best source in the media 12 itself. If one size label is to be printed, it is possible to pre-position the strip of labels in the printer and then keep track of how far the strip has moved. This, of course, requires computational capability once again as well as a memory to maintain the position when the printer is turned off. If there is any slippage, the position information slips as well. Moreover, if a different sized label is used, there must be provision for the user to re-program the printer as to the current printer size. All in all, not a very practical approach.

As depicted in FIG. 4, the media 12 may comprise a plurality of pre-cut labels 32 with no space between them. The prior art typically addresses that by putting positional marks 34 on the media 12 at the start of each label 32 where it does not affect the labels 32 themselves. As shown in FIG. 5, where the pre-cut labels 32 are separated by a gap 36, the marks 34 are not necessary since the edges of the labels 32 can be detected physically by a number of means.

Recently, the linerless media mentioned above has gained great popularity since it does not produce any backing materials that must be disposed of. This is particularly important in automated labeling machines and the like. As depicted in FIG. 6 in simplified form, the media 12 is a strip of paper or such having a surface on the top which accepts the printing ink and adhesive on the opposite or back surface. The media 12 comes off its supply roll 14 and passes under a printhead 38 where the information 40 is printed on it. It then proceeds to a cutter 42 which cuts off the printed label 44. For such a simple application, positional information is unnecessary.

Most companies want their labels to have pre-printed information 46 on them such as, the sending company, its return address, possibly a logo, and the like. Not only does this provide return address information in the event the package is undeliverable as addressed for some reason; but, in addition, it is a form of identification as the packages move through the delivery system. As depicted in FIG. 8, the information 40 is intended to be printed in a proper area with relation to the pre-printed information 46 such that a proper label 44 is created when the media is cut on line 48 as in the left side of the drawing figure. In the absence of proper positional information, however, the information 40 may be mis-printed as in the right side of the drawing figure. Thus, for printing on such pre-printed but not pre-cut media, positional information becomes an absolute necessity. One could sense the pre-print 46, but that has certain limitations. Primarily, it would make the position of the pre-print 46 fixed and, quite likely, severely limit the size and style of the pre-print 46; or, it would require a movable sensor to find the mark greatly adding to the complexity of the printer with attendant problems of reliability, wear, and cost of manufacture. Moreover, there would still be the problem of providing speed/motion information if desired or necessary to the implementation.

Since it is not pre-cut and therefore has no "edges" on the top surface where marks 34 can be made as in FIG. 4, that prior art technique is not available. And, since the back surface is covered with adhesive, it is not practical to put positional or speed/motion marks on the back.

Wherefore, it is an object of the present invention to provide a method and apparatus for marking and sensing positional and/or speed/motion information on a linerless media.

It is another object of the present invention to provide a method and apparatus for marking and sensing positional and/or speed/motion information on the printing surface of a linerless media in a manner which does not visually interfere with normal markings thereon.

It is still another object of the present invention to provide a method and apparatus for identifying pre-prints on the printing surface of a linerless media and ensuring correct printing registration.

It is yet another object of the present invention to provide a method and apparatus for marking and sensing positional information of a linerless media in a manner which does not limit the size, style, or position of pre-prints on the final labels.

It is a further object of the present invention to provide a method and apparatus for marking and sensing speed/motion information on the printing surface of a linerless media in a manner which allows mediadependent information to be provided by the media itself.

It is a still further object of the present invention to provide a method and apparatus for providing and sensing speed/motion information of a linerless media in implementations not employing a drive motor for the media.

Other objects and benefits of this invention will become apparent from the description which follows hereinafter when read in conjunction with the drawing figures which accompany it.

SUMMARY

The foregoing objects have been achieved by methods and associated apparatus of the present invention including a method of detecting a critical speed of linear movement of a strip media comprising the steps of, establishing a threshold frequency as an indicator of a critical speed; marking a strip of media with marks along the length thereof at a spacing such that when detected, they will be at the threshold frequency when the strip of media is moving at a critical speed; and, at a time of use of the strip of media, sensing the frequency of occurrence of the marks and indicating a critical speed has been attained when the sensed frequency is equal to the threshold frequency.

The invention also includes a method of establishing positions along the length of a strip of linerless media comprising the steps of, marking a printing surface of the strip of linerless media with position marks associated with pre-defined positions in a manner which does not visually impair subsequent printing on the printing surface; and, at a time of use of the strip of media, sensing the position marks to find the pre-defined positions.

The step of marking a printing surface of the strip of linerless media with position marks associated with pre-defined positions in a manner which does not visually impair subsequent printing on the printing surface may comprise marking the surface with an ink which is invisible under normal illumination. In such case, the step of sensing the position marks to find the pre-defined positions comprises illuminating the ink with a light which makes it visible and sensing the illuminated ink.

The step of marking a printing surface of the strip of linerless media with position marks associated with pre-defined positions in a manner which does not visually impair subsequent printing on the printing surface may also comprise marking the surface with pinholes through the media.

In that case, the step of sensing the position marks to find the pre-defined positions comprises directing a light beam onto the printing surface along a path of the pinholes and sensing light passing through the pinholes.

The invention additionally includes a method of establishing the linear speed of movement of a strip of linerless media comprising the steps of, marking a printing surface of the strip of linerless media with equally spaced motion/timing marks in a manner which does not visually impair subsequent printing on the printing surface; and, at a time of use of the strip of media, sensing the motion/timing marks to determine the speed of the strip of media by relating the frequency of the detected marks at a known spacing to an associated speed.

This method too may be accomplished by marking the surface with an ink which is invisible under normal illumination; illuminating the ink with a light which makes it visible; and, sensing the illuminated ink. It can also be accomplished by marking the surface with pinholes through the media; directing a light beam onto a surface of the media along a path of the pinholes; and, sensing light passing through the pinholes.

DESCRIPTION OF THE PREFERRED EMBODIMENT

Figure 9:
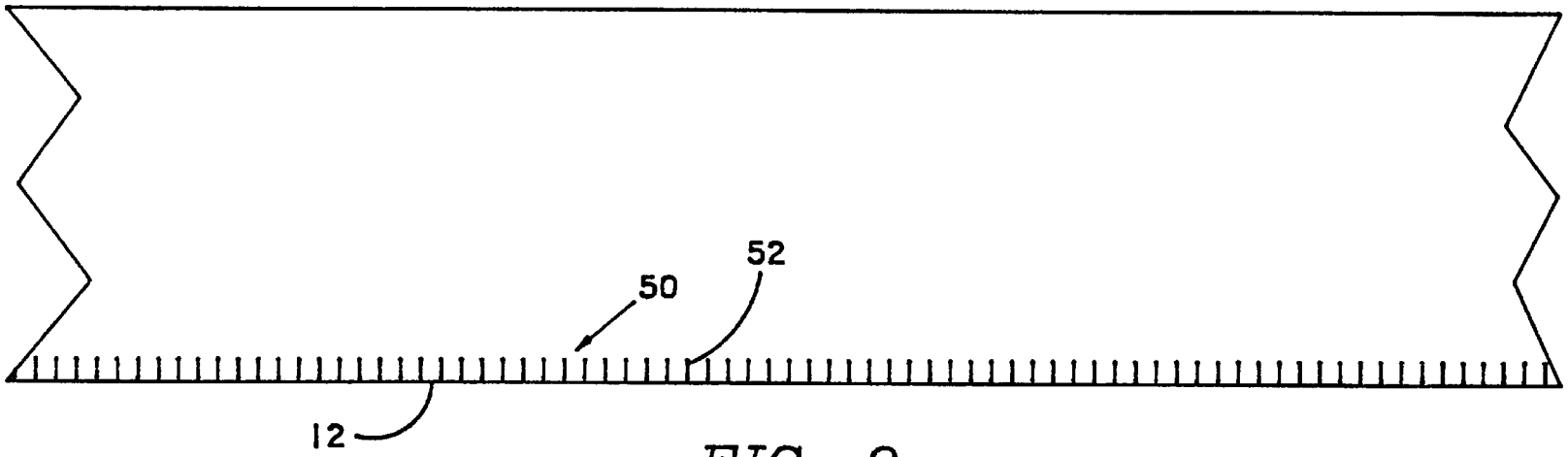
FIG. 9 is a simplified drawing of strip media according to the present invention in a first embodiment providing speed/motion determination markings only.

A first embodiment of the present invention is shown in FIG. 9. In this embodiment, motion/timing marks 50 are provided in the form of a series of lines 52 along one edge of the top surface of the media 12. While they are shown visible in the drawing figure for purposes of understanding, the lines 52 are actually invisible to the naked eye so that they do not interfere with the esthetics of the final labels as printed. The form factor of the mark may be a line across the beb or a line of a specific shape positioned in a predetermined location on the web. This aspect will be re-addressed shortly when the sensing apparatus is discussed in greater detail.

Figure 10:
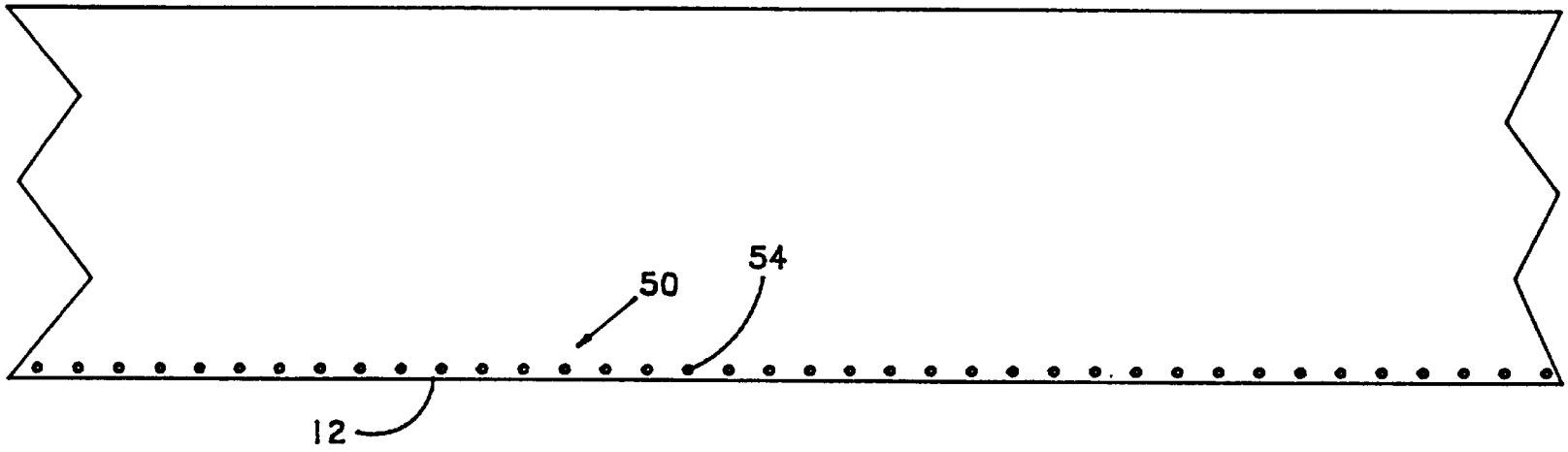
FIG. 10 is a simplified drawing of strip media according to the present invention in a second embodiment providing speed/motion determination markings only.

A second embodiment of the present invention is shown in FIG. 10. In this embodiment, the motion/timing marks 50 are provided in the form of a series of small holes 54 along one edge of the top surface of the media 12. As will also be addressed in relation to the sensing apparatus shortly herein, the holes 54 are essentially pinholes and, in fact, can be added to the media by passing it through a station during manufacture where there is a wheel with puncturing pins disposed about its periphery.

In addition to providing basic timing/speed information in the form of a series of binary signals output by the detector as each hole 54 or line 52 is sensed to be used in a typical prior art fashion to determine the speed/motion of the media 12, according to another aspect of the present invention the spacing of the holes 54 or lines 52 comprising the motion/timing marks 50 is set to indicate critical speeds of the associated media 12. That way, the printer 10 can be independent of the media type with regard to avoiding critical speeds such as those creating standing waves as mentioned earlier. If the printer 10 is provided with a signal at a certain bit rate from the detector detecting the motion/timing marks 50, it knows that it is at a critical speed and should adjust itself or take other corrective action accordingly. The manufacturer of the media 12 knows any critical speeds and places the holes 54 or lines 52 comprising the motion/timing marks 50 at a spacing which will produce the selected bit rate within the printer 10 at use time.

Figure 11:
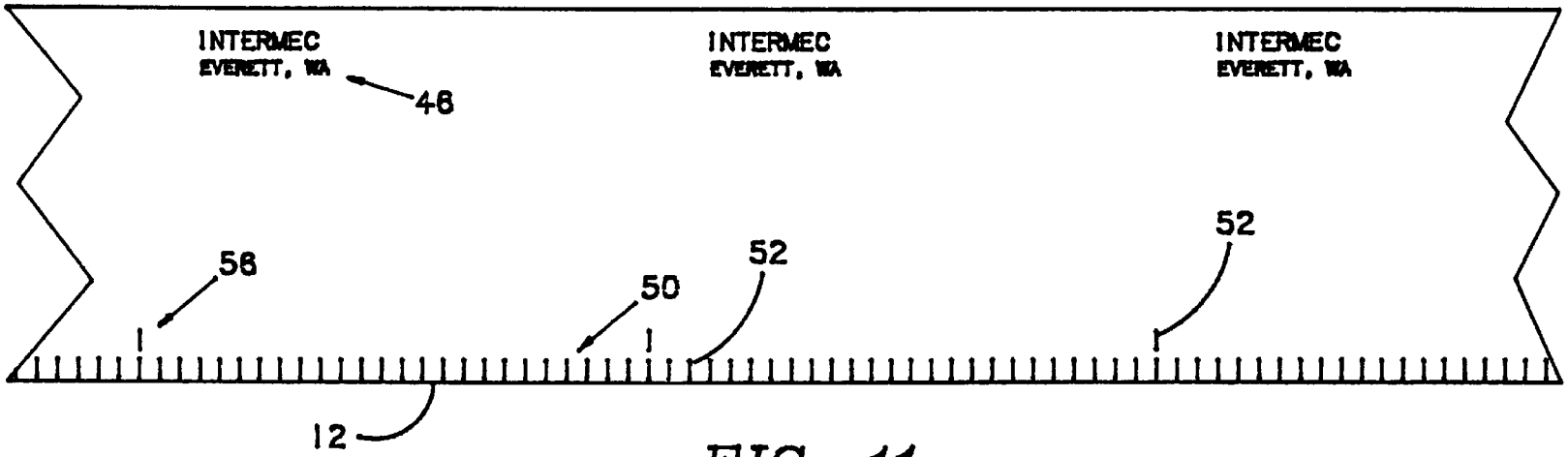
FIG. 11 is a simplified drawing of the strip media according to the present invention in its first embodiment providing both speed/motion and position determination markings.
Figure 12:
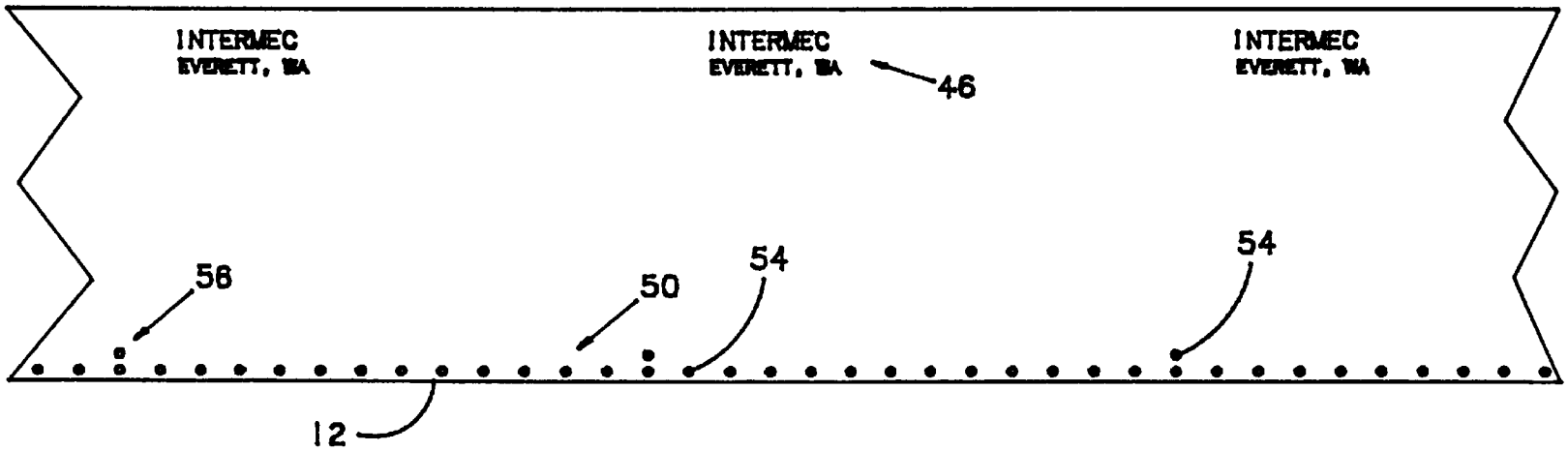
FIG. 12 is a simplified drawing of the strip media according to the present invention in its second embodiment providing both speed/motion and position determination markings.

In FIGS. 11 and 12, position marks 56 in the form of lines 52 and holes 54 are shown for the first and second embodiments of the present invention, respectively. The position marks 56 can be used alone where motion/timing marks 50 are not needed or desired; or, can be used with the motion/timing marks 50 as shown in the drawing figures. The position marks 56 indicate a position with respect to the start or end of a label 44 when the media 12 has been printed and cut. By knowing where the pre-print 46 is located with respect to the mark 56, the position of the pre-print 46 can also be determined, if desired.

Figure 14:
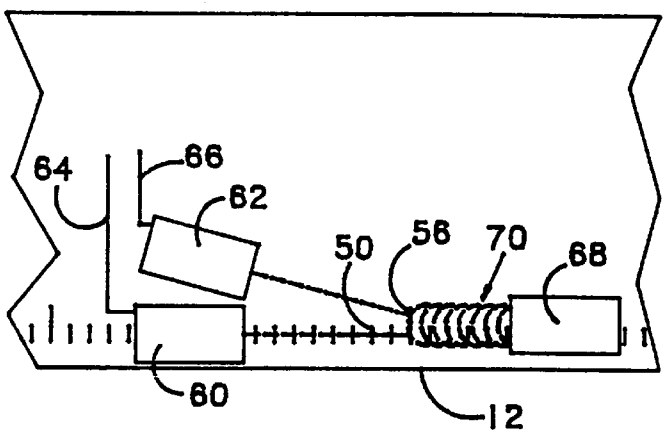
FIG. 14 is a top view of the apparatus of FIG. 13.
Figure 13:
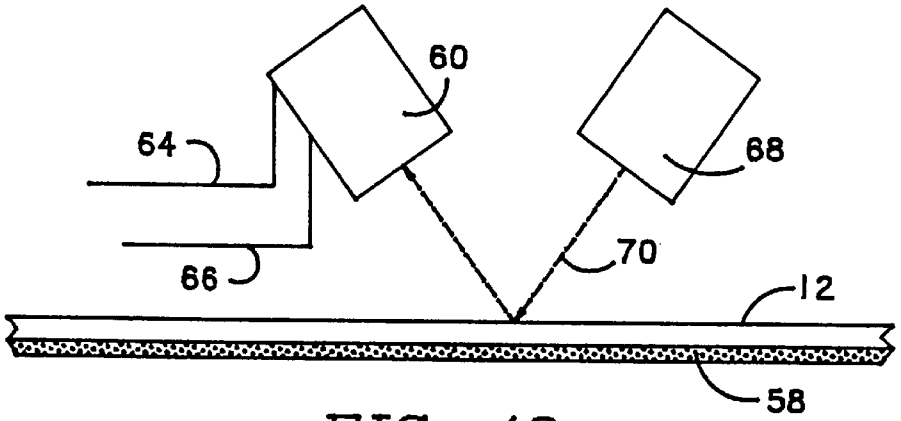
FIG. 13 is a simplified side view drawing of apparatus for reading the markings of the first embodiment of the present invention.

The apparatus for sensing the marks 50, 56 in the two embodiments will now be addressed in detail. Referring first to FIGS. 13 and 14, the "invisible" lines 52 are illuminated and sensed by the apparatus depicted therein. Inks that are visible only under certain wavelengths such as UV and IR are commercially available and well known to those of ordinary skill in such arts and will not be addressed with any particularly herein as their formulations form no part of the novelty herein, per se. As depicted in the drawing figures, the media 12 has adhesive 58 on its back surface. The lines 52 as pre-printed on the top edge of the media 12 are sensed by a pair of sensors 60, 62. Again, such sensors are commercially available and well known to those of ordinary skill in such arts and will not be addressed with any particularly herein along with the light source used therewith. Suffice it to say that if a UV-fluorescing ink is employed for the lines 52, the light source and sensors should be such as to fluoresce the ink and then detect it. The sensor 60 is positioned to detect the motion/timing marks 50 and the sensor 62 is positioned to detect the position marks 56 as best seen in FIG. 14. When the sensor 60 detects a motion/timing mark 50, it outputs an electrical signal pulse on line 64 and when the sensor 62 detects a positional mark 56, it outputs an electrical signal pulse on line 66. The light source 68 emits a beam of light 70 (of appropriate type) onto the path of the marks 50, 56. Thus, as the media 12 moves under the sensors 60, 62, the marks 50, 56 are detected and corresponding signals are output on lines 64, 66 to be processed as described above by conventional processing logic within the associated printer 10.

Figure 15:
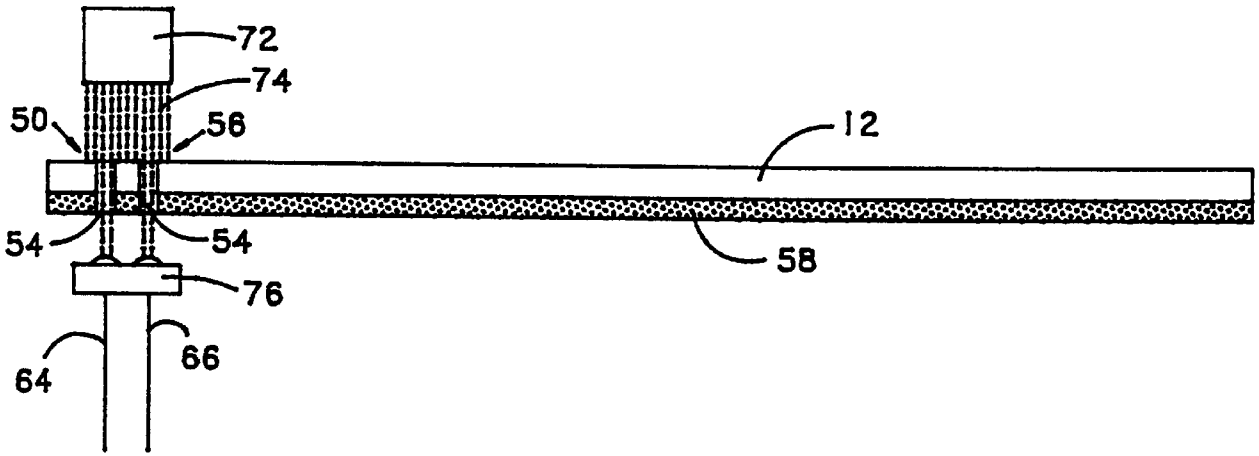
FIG. 15 is a simplified, cutaway drawing through media of the present invention showing apparatus for reading the markings of the second embodiment of the present invention.

The apparatus for sensing the holes 54 of the second embodiment is depicted in FIG. 15. In this case, a light source 72 is positioned above the media 12 and a dual channel sensor 76 is positioned under it. The light source 72 emits a beam of light 74 onto the path of the holes 54 and the sensor 76 is positioned to have one channel's sensing surface under the path of the timing holes 50/54 and the other channel's sensing surface under the path of the position holes 56/54. In this case, the light 74 can be of any type sensible by the sensor 76. The only limitation is that the intensity of the light 74 should be sufficient with relationship to the sensitivity of the sensor 76 such that the amount of light which passes through the pinholes 54 as compared with the transmission, if any, through the media 12 and adhesive 58 will cause an output signal on the associated output line 64, 66 at the position of a hole 54 and only at the position of a hole 54. Thus, just like the sensing apparatus of FIGS. 13 and 14 for the first embodiment, when the sensor 76 detects a motion/timing mark 50, it outputs an electrical signal pulse on line 64 and when the sensor 76 detects a positional mark 56, it outputs an electrical signal pulse on line 66.

Figure 1:
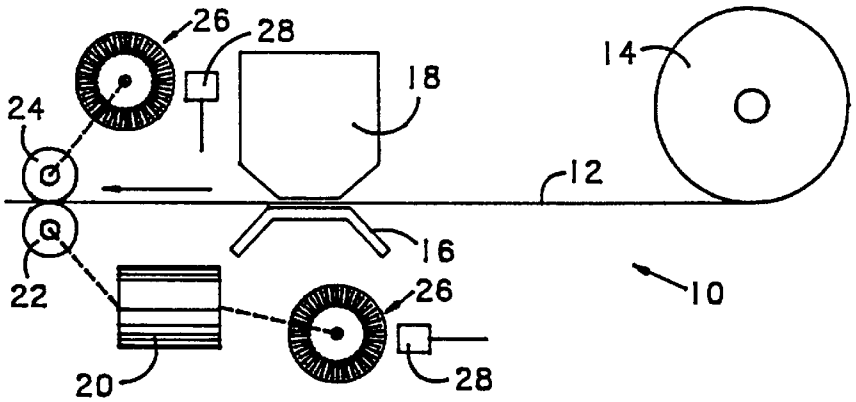
FIG. 1 PRIOR ART
FIG. 1 is a simplified drawing of a prior art media printer employing an encoded wheel for speed/motion and/or positional information.
Figure 2:
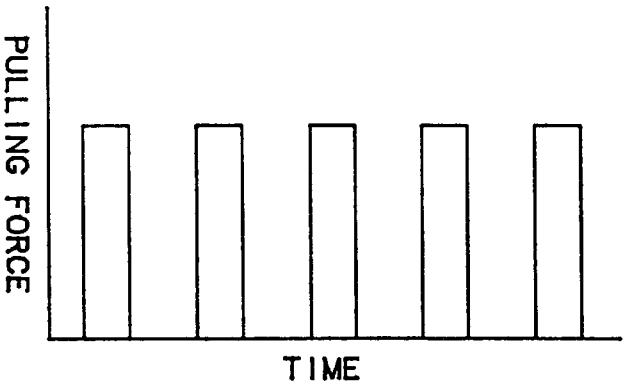
FIG. 2 PRIOR ART
FIG. 2 is a graph showing the movement applied to the media of FIG. 1 by the drive motor.
Figure 3:
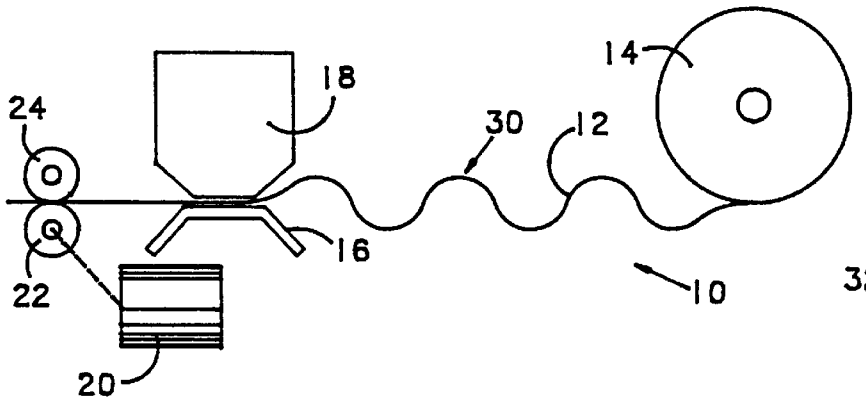
FIG. 3 PRIOR ART
FIG. 3 is a simplified drawing showing how standing waves can be produced in the media by the movement action of FIGS. 1 and 2.
Figure 4:
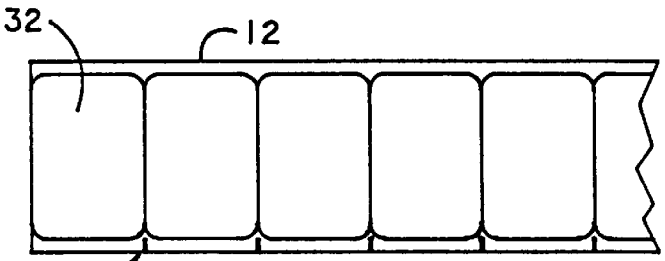
FIG. 4 PRIOR ART
FIG. 4 is a simplified drawing showing how the backing of adjacent pre-cut labels is marked in the prior art to allow the start of each label to be identified.
Figure 5:
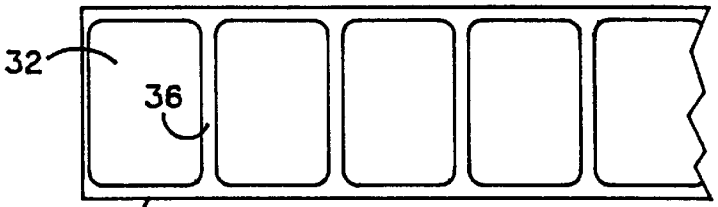
FIG. 5 PRIOR ART
FIG. 5 is a simplified drawing showing how pre-cut labels which are separated on their backing sheet need no marking in the prior art since the label edges can be physically detected by the printing apparatus.
Figure 6:
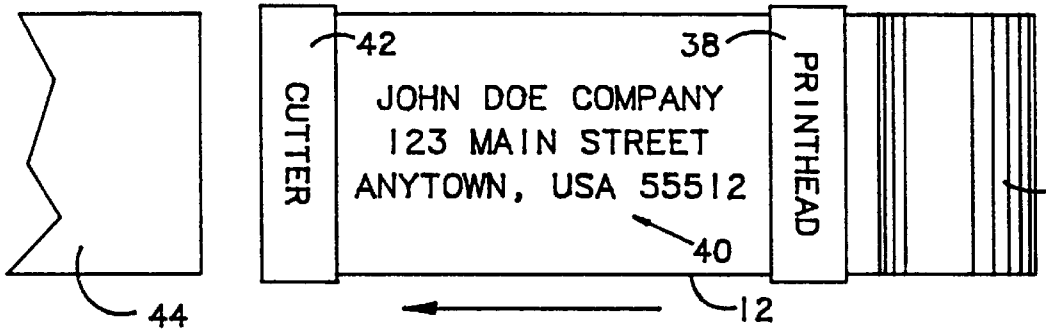
FIG. 6 PRIOR ART
FIG. 6 is a simplified drawing showing how strip media is printed and cut into labels according to prior art techniques.
Figure 7:
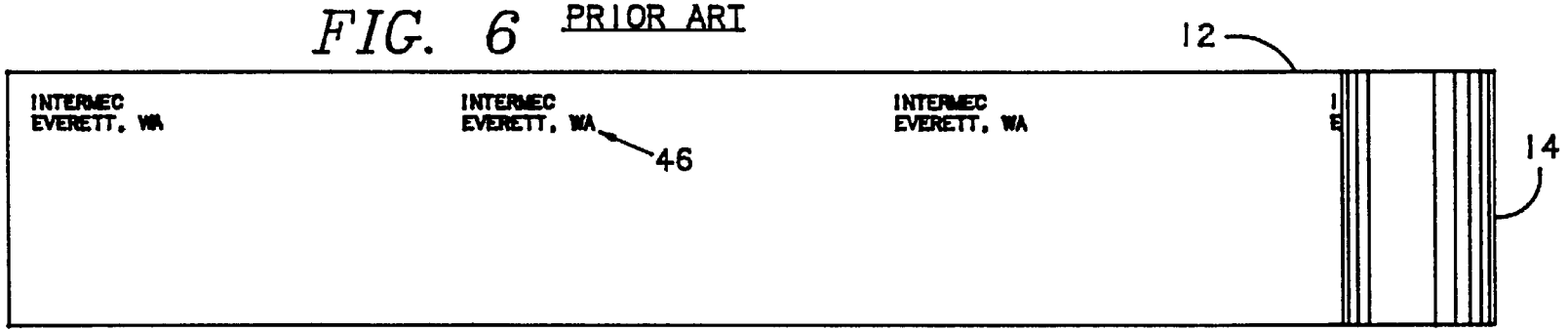
FIG. 7 PRIOR ART
FIG. 7 shows a prior art strip media having pre-prints of sender information on it.
Figure 8:
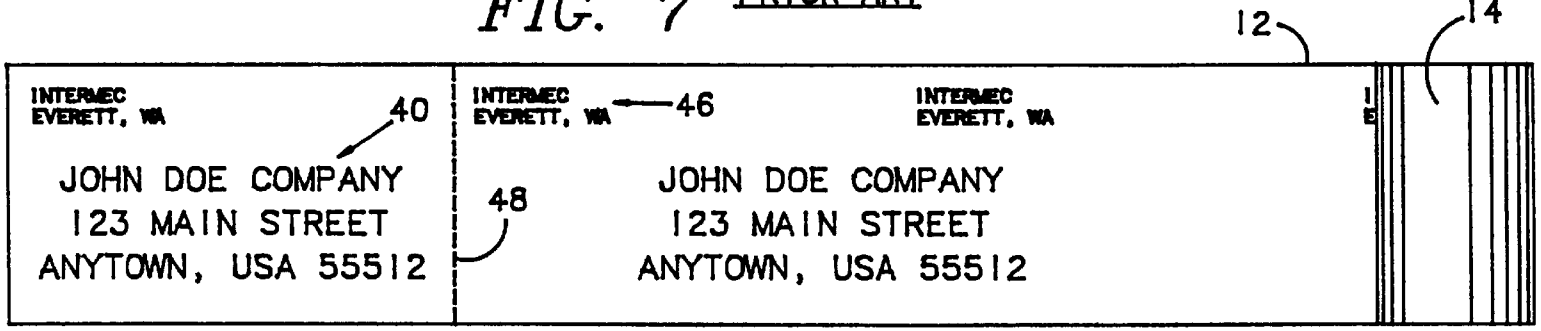
FIG. 8 PRIOR ART
FIG. 8 depicts how addressee information is intended to be printed on the strip media of FIG. 7 and how it can be mis-printed if the printing apparatus is unable to determine the location of the pre-print before printing.
Figure 16:
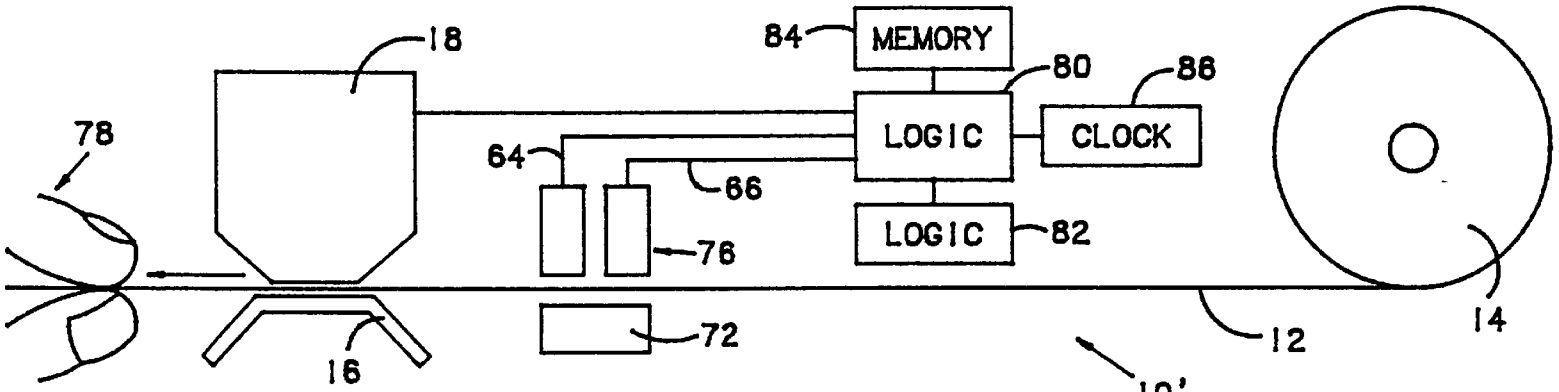
FIG. 16 is a simplified drawing of a label printer according to the present invention which does not have a drive motor.

A clearer understanding of the importance of the present invention in certain applications can be had with particular reference to the printer 10' of FIG. 16. The printer 10' has an important difference as compared to the prior art printer 10 of FIG. 1—there is no motor to drive the media 12 through the printer 10'. Rather, it is intended that the printer 10' be small, light-weight, inexpensive, and simple. To this end, the drive motor 20 is omitted and the media 12 is pulled through the printer 10' by a user's fingers 78 as indicated by the arrow. For purposes of an example, assume that the marks 50, 56 are made according to the second embodiment (i.e. they are holes 54 through the media 12) such that detection is by a light source 72 on one side of the media 12 and detection is by the dual-channel sensor 76 aligned to sense the paths of the marks 50, 56 and output an appropriate signal on lines 64, 66, respectively, when a mark is detected. The lines 64, 66 are input to the logic 80 and the logic 80 is connected to drive the printhead 18. The logic 80 gets its inputs from the main printer logic 82 operating in a conventional manner.

Figure 17:
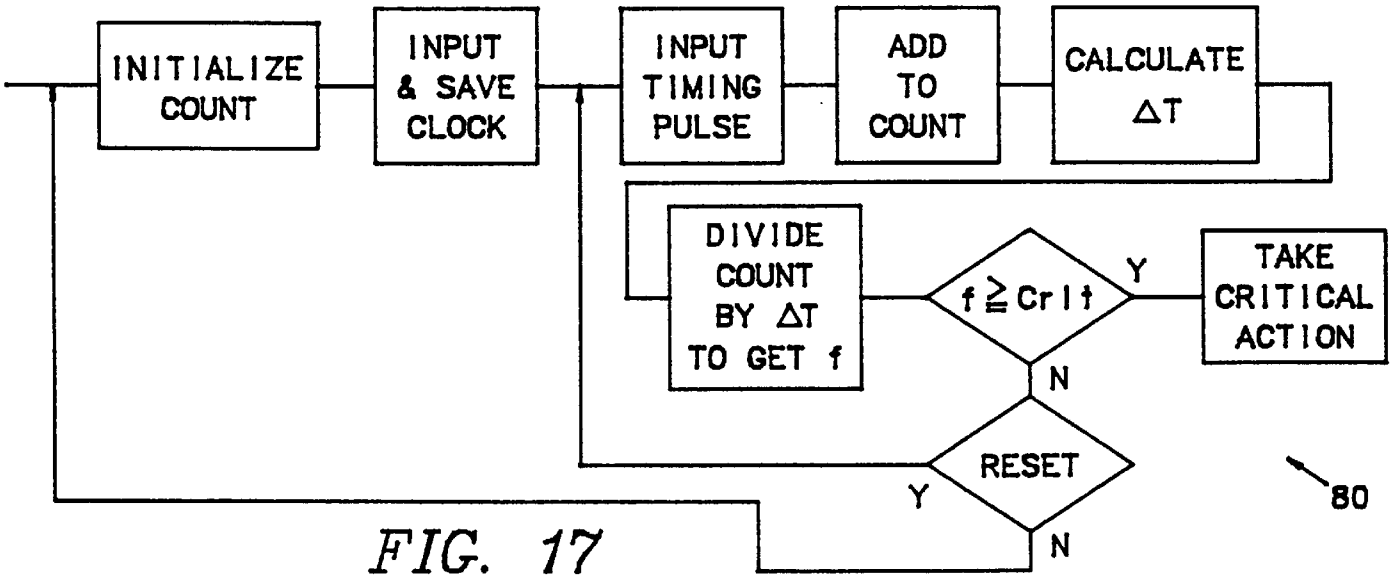
FIG. 17 is a logic flow diagram of one way in which the critical speed determination aspect of the present invention can be implemented.

Digressing for a moment, if one were to detect a critical speed in this printer or any other (with or without a drive motor), a memory 84 and a free-running clock 86 could be added and connected to the logic 80. To detect critical speeds according to one possible approach as shown in the logic diagram of FIG. 17, the logic 80 would begin a test sequence by initializing a pulse count in the memory 84 and also input and save the instantaneous value of the clock 86. The logic 80 would then start a testing loop by inputting a next-detected timing pulse on the line 64 and add it to a running count in the memory 84. The elapsed time in clock bits would then be determined by subtracting the initial value of the clock 86 as saved in memory 84 from the current value of the clock 86. The current timing pulse count would then be divided by the elapsed time to determine the present pulse frequency. If that frequency is equal to or greater than the pre-stored frequency indicating the critical speed of interest, the critical action path would be taken. If it was a question of possible standing waves being produced, the speed of the media 12 could be reduced. If the critical speed related to the ability of the printhead 18 to print properly, the printing could be stopped, the speed could be reduced, or a warning alarm sounded to the user, as appropriate. If the critical speed has not been attained, the logic 80 would determine if it is time to start a new test period. If not, it would return to the start of the inner loop to look for a next timing mark 50. If time, it would return to the outer loop to initialize the counters once again. In this regard, the test periods would be a matter of designer choice. They should not be so short as to cause a critical speed alert for a short burst of speed that has no effect. On the other hand, they should not be so long that critical speed periods of possible harm are balanced out in an overall average and, therefore, overlooked.

Figure 18:
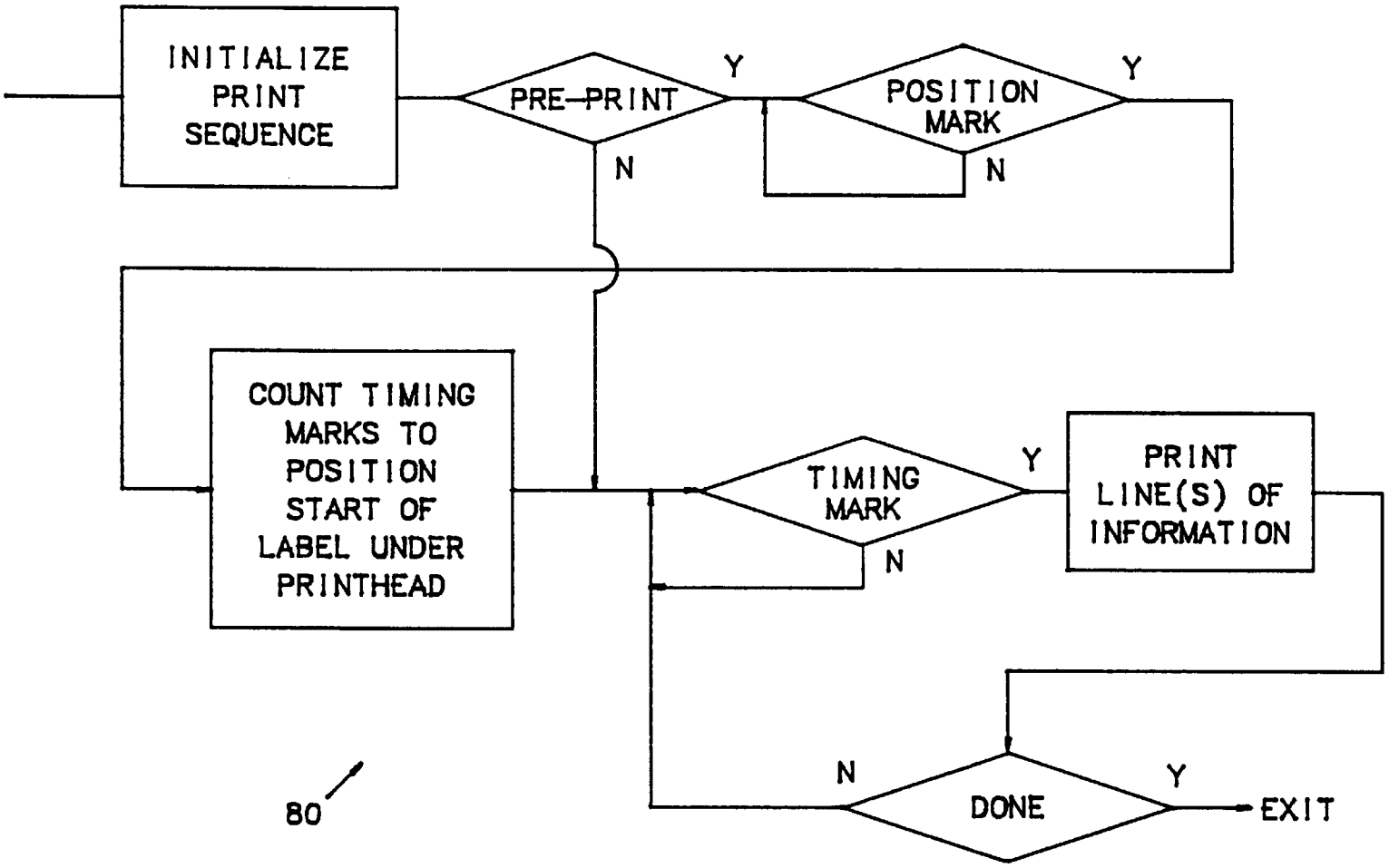
FIG. 18 is a logic flow diagram of one way in which the position and motion determination logic for a motorless printer as in FIG. 16 can be implemented.

Returning to the concept of a motor-less printer 10' in particular once again, those of ordinary skill in the art should begin to see and appreciate the problem the designer of such equipment would face without the benefits and capabilities provided by the present invention. With a motor, once printing begins the associated logic need only output lines of printing to the printhead 18 on a timed basis directly related to the motor speed (which directly corresponds, of course, to media speed). Without a motor, the printer logic 82 is unable to figure out when to output print signals to the printhead 18. The logic of FIG. 18 when implemented in the logic 80 takes care of that problem.

When the logic 82 desires to print a label and sends associated print information to logic 80, logic 80 attends to the problem of determining where and when to print each line on the media 12. The media 12 is, of course, according to the present invention as described above and contains timing/motion marks 50 as well as position marks 56 if appropriate. In other words, if there are no pre-prints 46 and the media 12 is simply a plain printing surface, there is no need for position marks 56 since there is no beginning or end of a label 44 to align for printing. The first thing the logic 80 does is to initialize the print sequence as necessary. It then asks if it is printing on media 12 having pre-prints 46. If it is, the logic 80 cycles waiting until a position mark 56 is detected. Once the position mark 56 is detected, the logic 80 starts counting detected timing/motion marks 50 until it knows that the start of printing position is under the printhead 18. Once the printing position is under the printhead 18, the logic 80 performs the same logic steps as if there were no pre-prints 56. The logic 80 waits for a timing/motion mark 50 indicating that the media 12 has moved. If the user stops pulling the media 12, the logic 80 will not print a next line of the printing until the media 12 has been moved the proper distance. If the media 12 is pulled unevenly, the printing will only occur when the proper movement of the media 12 has taken place. That is why the marks 50 are referred to as timing/motion marks. In the presence of constant motion, the marks 50 can be used to determine speed. In the presence of inconsistent motion or sporadic motion, the marks 50 can only determine that motion has taken place and the amount of that motion, i.e. distance. After each line of printing has been output, the logic 80 checks to see if it is finished. When it is, it exits to wait for the next printing output request. If it is not, it returns to the start of the printing loop to wait for a next mark 50.

Wherefore, having thus described the present invention, what is claimed is:

1. A method of detecting a critical speed of linear movement of a strip media comprising the steps of:

a) pre-marking the strip media along the length thereof with equally spaced marks wherein the distance between adjacent marks corresponds to a critical speed of the media; and, b) at a time of printing onto the media, sensing the frequency of occurrence of the marks and indicating that said critical speed has been attained when the sensed frequency is equal to a pre-established frequency of a critical speed.

2. A method of detecting a critical speed of linear movement of a strip media comprising the steps of:

a) establishing a threshold frequency as an indicator of a critical speed;

b) pre-marking a strip of media with marks along the length thereof at a spacing such that when detected, they will be at the threshold frequency when the strip of media is moving at a critical speed; and, c) at a time of printing onto the strip of media, sensing the frequency of occurrence of the marks and indicating that said critical speed has been attained when the sensed frequency is equal to the threshold frequency.

3. A method of establishing positions along the length of a strip of linerless media comprising the steps of:

a) pre-marking a printing surface of the strip of linerless media with position marks associated with pre-defined positions in a manner which does not visually impair subsequent printing on the printing surface; and, b) at a time of use of the strip of media, sensing the position marks to find the pre-defined positions.

4. The method of claim 3 wherein said step of pre-marking a printing surface of the strip of linerless media with position marks associated with pre-defined positions in a manner which does not visually impair subsequent printing on the printing surface comprises:

marking the surface with an ink which is invisible under normal illumination.

5. The method of claim 4 wherein said step of sensing the position marks to find the pre-defined positions comprises:

a) illuminating the ink with a light which makes it visible; and, b) sensing the illuminated ink.

6. The method of claim 3 wherein said step of pre-marking a printing surface of the strip of linerless media with position marks associated with pre-defined positions in a manner which does not visually impair subsequent printing on the printing surface comprises:

marking the surface with pinholes through the media.

7. The method of claim 6 wherein said step of sensing the position marks to find the pre-defined positions comprises:

a) directing a light beam onto a surface of the media along a path of the pinholes; and, b) sensing light passing through the pinholes.

8. A method of establishing the linear speed of movement of a strip of linerless media comprising the steps of:

a) pre-marking a printing surface of the strip of linerless media with equally spaced motion/timing marks in a manner which does not visually impair subsequent printing on the printing surface; and, b) at a time of use of the strip of media, sensing the motion/timing marks to determine the speed of the strip of media by relating the frequency of the detected marks at a known spacing to an associated speed.

9. The method of claim 8 wherein said step of pre-marking a printing surface of the strip of linerless media with position marks associated with pre-defined positions in a manner which does not visually impair subsequent printing on the printing surface comprises:

marking the surface with an ink which is invisible under normal illumination.

10. The method of claim 9 wherein said step of sensing the position marks to find the pre-defined positions comprises:

a) illuminating the ink with a light which makes it visible; and, b) sensing the illuminated ink.

11. The method of claim 8 wherein said step of pre-marking a printing surface of the strip of linerless media with position marks associated with pre-defined positions in a manner which does not visually impair subsequent printing on the printing surface comprises:

marking the surface with pinholes through the media.

12. The method of claim 11 wherein said step of sensing the position marks to find the pre-defined positions comprises:

a) directing a light beam onto a surface of the media along a path of the pinholes; and, b) sensing light passing through the pinholes.

* * * * *